US005104286A

United States Patent [19]

Donlan

[11] Patent Number: 5,104,286

[45] Date of Patent: Apr. 14, 1992

[54] RECIRCULATION SEAL FOR A GAS TURBINE EXHAUST DIFFUSER

[75] Inventor: John P. Donlan, Oviedo, Fla.

[73] Assignee: Westinghouse Electric Corp., Pittsburgh, Pa.

[21] Appl. No.: 652,693

[22] Filed: Feb. 8, 1991

[51] Int. Cl.[5] ..... F04D 29/08

[52] U.S. Cl. ..... 415/170.1; 277/230

[58] Field of Search ..... 415/170.1, 174.2, 182.1, 415/108, 208.1, 220, 229, 230, 231; 277/88, 229, 230

[56] References Cited

U.S. PATENT DOCUMENTS

| | | | |
|---|---|---|---|
| 2,314,289 | 3/1943 | Salisbury | 415/174.2 |
| 2,766,055 | 10/1956 | Poltorak | 277/230 |
| 3,020,185 | 2/1962 | Moffitt, Jr. et al. | 277/229 |
| 4,415,309 | 11/1982 | Atterbury | 415/174.2 |
| 4,438,939 | 3/1984 | Pask et al. | 277/88 |
| 4,462,603 | 7/1984 | Usher et al. | 277/230 |
| 4,747,750 | 5/1988 | Chlus et al. | 415/173.7 |
| 4,932,207 | 6/1990 | Harris et al. | 415/174.2 |

FOREIGN PATENT DOCUMENTS

| | | | |
|---|---|---|---|
| 1724 | 1/1909 | United Kingdom | 277/229 |

*Primary Examiner*—Edward K. Look
*Assistant Examiner*—Michael S. Lee

[57] ABSTRACT

A seal is provided to prevent the recirculation of hot gas through an annular cavity formed between the outer flow liner of a diffuser and an exhaust cylinder in the exhaust section of a gas turbine. The seal is formed from a high temperature cloth, such as fiber glass, which is sandwiched between two layers of a fine wire mesh. The seal is comprised of a plurality of arcuate segments. Although the cloth has a rectangular shape when in its undeformed state, it takes an arcuate shape as a result of being crimped within inner and outer arcuate channels. The seal is retained by sliding the channels into circumferential grooves in the exhaust cylinder and outer flow liner. An expansion loop is formed in the seal to allow for differential expansion between the exhaust cylinder and the outer liner.

25 Claims, 3 Drawing Sheets

RECIRCULATION SEAL FOR A GAS TURBINE EXHAUST DIFFUSER

BACKGROUND OF THE INVENTION

The current invention relates to a seal in the exhaust section of a gas turbine. More specifically, the current invention relates to a seal for preventing the recirculation of hot gas through an annular cavity formed between an exhaust diffuser and an exhaust cylinder in a gas turbine.

In an axial flow gas turbine, the hot gas leaving the last row of turbine blades is directed through an exhaust diffuser, thereby increasing the pressure ratio across the turbine section of the gas turbine. The exhaust diffuser is formed by inner and outer flow liners disposed between an exhaust cylinder and a bearing housing. The flow liners serve to create a smooth flow path for the hot gas. They also act as a barrier which prevents the flow of hot gas directly over the exhaust cylinder and bearing housing, thereby preventing excessive temperatures and thermal stresses in these components.

There is an annular cavity between the outer flow liner and the exhaust cylinder. Since any flow of hot gas through this cavity would undesirably heatup the exhaust cylinder, ideally this cavity is a dead air space. However, to allow for differential thermal axial expansion, there is a gap between the outer flow liner and the adjacent upstream and downstream components. This gap creates a recirculation flow path for the hot gas through the annular cavity. In addition to causing excessive temperatures, thermal stresses, and distortion in the exhaust cylinder, such recirculation also upsets the aerodynamic performance of the diffuser.

In the past, the recirculation of gas through the annular cavity was prevented by a seal comprised of a plurality of steel plates bolted to both the downstream flange of the outer flow liner and the downstream flange of the exhaust cylinder and extending therebetween. By blocking the flow path through the annular cavity, the seal prevented recirculation of hot gas. Unfortunately, this seal is expensive and required a great number of man-hours to install, being comprised of over two hundred bolts, twenty-four retaining plates and six seal plates. Moreover, the differential thermal axial expansion between the outer flow liner and exhaust cylinder at each start-up of the gas turbine induced stresses in the seal plates which eventually caused them to crack by a fatigue mechanism.

Accordingly, it would be desirable to provide an exhaust diffuser recirculation seal which was relatively inexpensive, easy to install, and sufficiently flexible to withstand differential thermal expansion.

SUMMARY OF THE INVENTION

It is an object of the current invention to provide a seal for preventing the recirculation of hot gas through an annular cavity between an exhaust cylinder and an exhaust diffuser in the exhaust section of a gas turbine.

It is another object of the current invention that the seal be inexpensive, easy to install, and sufficiently flexible to withstand differential thermal expansion between the exhaust cylinder and exhaust diffuser.

These and other objects are accomplished in a gas turbine having an exhaust cylinder enclosing an outer flow liner which forms a portion of the exhaust gas flow path of a diffuser. An annular cavity is formed between the exhaust cylinder and the outer flow liner. A seal comprised of upper and lower accurate segments is disposed within the cavity and extends between the exhaust cylinder and the outer flow liner. The seal is formed by a fiber glass cloth which is sandwiched between two layers of wire mesh and retained in inner and outer accurate channels crimped onto the cloth. The seal is affixed to the exhaust cylinder and outer flow liner by sliding the channels into grooves formed therein.

DESCRIPTION OF THE PREFERRED EMBODIMENT

Figure 1:
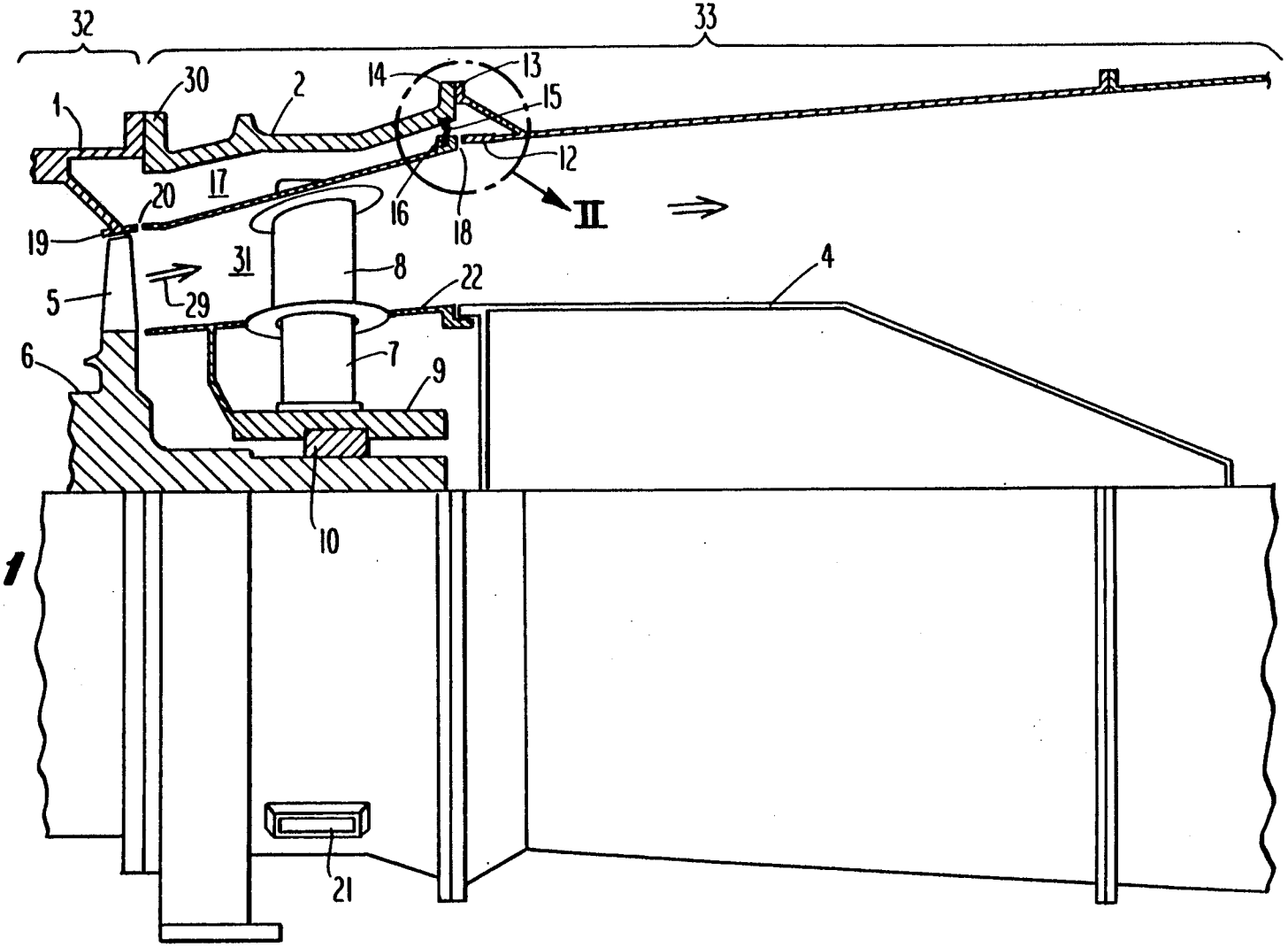
FIG. 1 is a partial longitudinal cross-section through the exhaust section of a gas turbine.

There is shown in FIG. 1 the exhaust section 33 of a gas turbine. The exhaust section 33 is comprised of an exhaust cylinder 2 which encloses a diffuser formed by approximately cylindrical inner 22 and outer 11 flow liners. Hot gas 29 exhausting from the last row of blades 5 in the turbine section 32 of the gas turbine flows through the exhaust section 33. From the exhaust section 33 the hot gas 29 may be either vented to atmosphere, in a simple cycle power plant, or directed to a heat recovery steam generator, in a combined cycle power plant.

The inner and outer flow liners form a portion of the flow path 31 for the hot gas 29. The inner flow liner 22 encloses a bearing housing 9 which contains a bearing 10 which supports a rotor 6. The bearing housing 9 is supported by struts 7 which extend between the bearing housing and the exhaust cylinder 2. The struts 7 are affixed to the exhaust cylinder at their distal ends 21. The portion of the strut 7 between the inner flow liner 22 and the exhaust cylinder 2 is surrounded by a shield 8 to retard the transfer of heat from the hot gas 29 to the strut.

As shown in FIG. 1, an exhaust manifold outer cylinder 3 extends downstream from the exhaust cylinder 2 and is bolted at its upstream flange 13 to the exhaust cylinder downstream flange 14. A flow guide 12 extends from the exhaust manifold outer cylinder 3 inboard of the flange 13 so as to form a smooth flow path with the outer flow liner 11. A turbine cylinder 1 is bolted to the upstream flange 30 of the exhaust cylinder 2. A shroud 19 is attached to the turbine cylinder 1 and encircles the tips of the last row blades 5. An exhaust manifold inner cylinder 4 is also shown in FIG. 1 and extends downstream from the inner flow liner 22.

As shown in FIG. 1, the tip shroud 19 and the flow guide 12 are disposed upstream and downstream, respectively, of the outer flow liner 11. In order to allow for axial thermal expansion, circumferential gaps 20 and 18 are formed between the outer flow liner 11 and the shroud 19 and flow guide 12, respectively.

Figure 2:
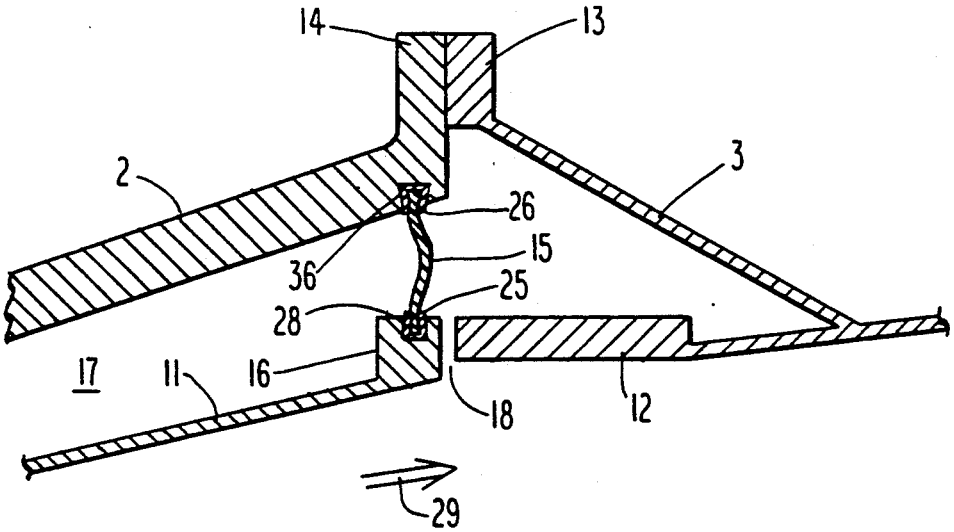
FIG. 2 is a detailed view of the portion of FIG. 1 denoted by the circle marked II in FIG. 1.

An annular cavity 17 is formed between the outer flow liner 11 and the exhaust cylinder 2, the outer flow liner forming the boundary between the hot gas path 31 and the annular cavity. As shown in FIG. 2, a seal 15 extends between the outside diameter of the outer flow liner rear flange 16 and the inside diameter of the exhaust cylinder rear flange 14. The seal 15 extends 360° around the cavity 17 so as to completely obstruct flow through the cavity.

As a result of the effect of the diffuser, the static pressure of the gas 29 is higher at the downstream gap 18, formed between the outer flow liner 11 and the flow guide 12, than at the upstream gap 20, formed between the outer flow liner 11 and the blade tip shroud 19. Although the pressure differential between the downstream gap 18 and the upstream gap 20 is typically no more than approximately 13.8 kPa (2 psi), were it not for the seal 15, this pressure differential would be sufficient to cause the hot gas 29 in the flow path 31 to recirculate through the cavity 17. Recirculation would occur by the hot gas 29 entering the annular cavity 17 at gap 18, flowing upstream through the cavity and reentering the gas flow path 31 at gap 20. As previously discussed, such recirculation causes undesirable heating of the exhaust cylinder 2 and disrupts the aerodynamic performance of the diffuser. The function of the seal, therefore, is to prevent this deleterious recirculation of the hot gas 29 through the annular cavity 17 so that the annular cavity remains essentially a dead air space.

Figure 3:
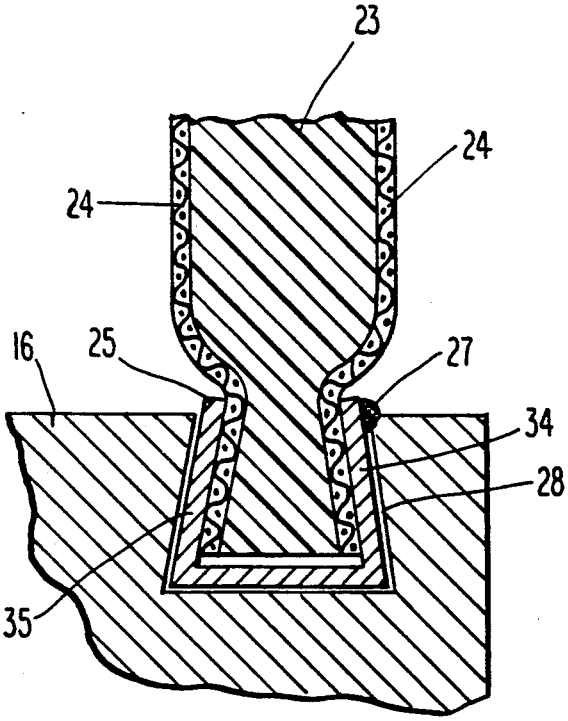
FIG. 3 is a detailed view of the seal in the vicinity of the outer flow liner groove.

As shown in FIG. 3, according to the current invention, the seal 15 is formed from a cloth 23—that is, a flexible material formed by weaving, knitting, pressing or felting fibers. Since the temperature of the gas is typically at least 370° C. (700° F.) and may be as high as approximately 540° C. (1000° F.), the cloth 23 must be formed from fibers capable of withstanding such temperatures. In the preferred embodiment, the cloth is approximately ⅜ inch thick and formed by weaving fiber glass. Such fiber glass cloth can typically withstand temperatures as high as 650° C. (1200° F.). Alternatively, the cloth 23 may be formed by weaving ceramic fibers for even higher temperature resistance.

As shown in FIG. 3, in order to protect the cloth 23 from damage, the radially extending faces of the cloth are sandwiched between two layers of a fine flexible wire mesh 24. In the preferred embodiment, the mesh 24 is formed from wire having a diameter of approximately 0.028 cm (0.011 inch) and has an open area of approximately 11.7%. Since the wire mesh 24 must be capable of withstanding high temperatures, the wire is preferably formed from Inconel or stainless steel.

Figure 6:
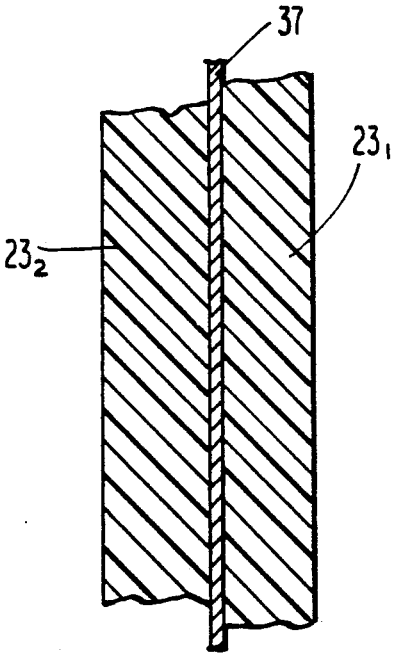
FIG. 6 is a cross-sectional view of an alternative embodiment of the seal according to the current invention.

In an alternative embodiment, the seal is formed by two layers $23_1$ and $23_2$ of cloth with a thin flexible metal sheet 37 disposed between the layers, as shown in FIG. 6. The metal sheet 37 is impermeable to the exhaust gas 29 and serves to provide a gas tight seal in those applications where even slight gas leakage across the seal cannot be tolerated.

Figure 4:
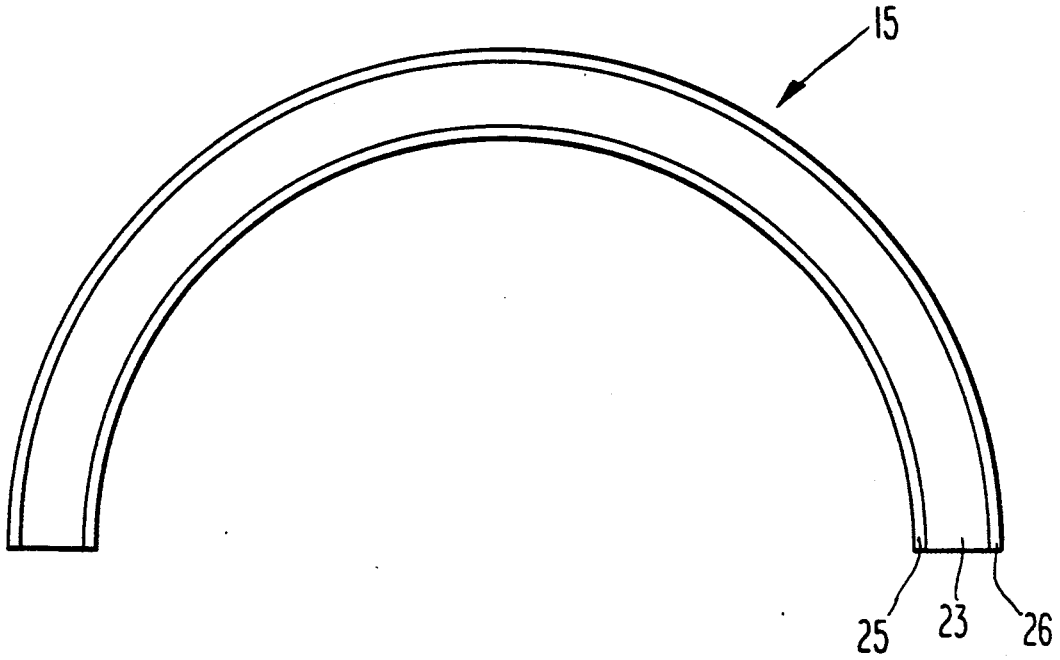
FIG. 4 is a view of the top half of the seal.

As shown in FIGS. 2, 3 and 4, the inner and outer edges of the cloth 23 are retained in arcuate channels 25 and 26, respectively. The channels have C-shaped cross-sections forming an open throat into which the edges of the cloth 23 are inserted. The channels 25 and 26 are securely attached to the cloth 23 by crimping the opposing legs 34 and 35 of the channels together so that the width of the throat is narrower than the thickness of the cloth 23, as shown in FIG. 3. This has the effect of securing the cloth to the channels by compression and also imparts a dovetail shape to the channels, facilitating the retention of the seal 15 in the exhaust cylinder and outer flow liner as explained further below.

The seal is comprised of a plurality of arcuate segments. In the preferred embodiment, two segments are utilized, one of which is shown in FIG. 4, each segment encompassing an arc of 180°. Since the exhaust cylinder 2 and outer flow guide 11 are comprised of upper and lower halves joined along horizontal joints (not shown), this configuration allows the seal to be divided into upper and lower halves as well, the upper half of the seal 15 being installed in the upper half of the exhaust cylinder 2 and outer flow liner 11 and the lower half of the seal being installed in the lower half of the exhaust cylinder and outer flow liner.

Figure 5:
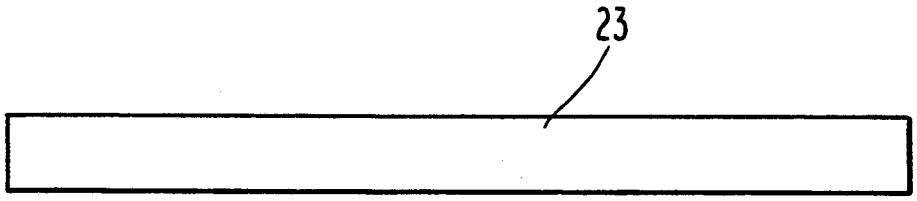
FIG. 5 is a plan view of the cloth portion of the seal shown in FIG. 4 in its undeformed state.

According to the current invention, initially the cloth may be formed by simply cutting a strip of suitable size from a larger piece of cloth. Thus, in its undeformed state the seal has the shape of a long rectangle, as shown in FIG. 5. The arcuate shape of the seal 15 is then created by attaching the cloth 23 to the arcuate channels 25 and 26.

As shown in FIG. 2, the seal 15 is retained by sliding the outer channel 26 into a circumferential groove 36 in the inside diameter of the exhaust cylinder rear flange 14 and sliding the inner channel 25 into a circumferential groove 28 in the outer diameter of the outer flow liner rear flange 16. The seal 15 is restrained in the radial direction by the dove tail shape of the grooves 28 and 36, which mates with the dove tail shape of the channels 25 and 26. As shown in FIG. 3, a weld joint 27 may be formed between the channels and the flanges to lock them into place circumferentially.

As can be see in FIG. 1, the outer flow liner 11 is a less massive member than the exhaust cylinder 2 and is exposed directly to the hot gas 29. Consequently, at start-up of the gas turbine, the outer liner heats up faster than the exhaust cylinder. Similarly, at shut down of the gas turbine, the outer liner cools faster than the exhaust cylinder. As a result, there is significant differential thermal expansion between the exhaust cylinder 2 and the outer flow liner 11 in both the radial and axial directions. Thus, according to an important aspect of the current invention, this differential thermal expansion is accommodated by forming the cloth 23 and the mesh 24 so that the width of seal 15 in the radial direction prior to installation is greater than the radial distance between the outer flow liner 11 and the exhaust cylinder 2 as measured across the grooves 28, 36. As a result of the excess material in the cloth and mesh, a flexible expansion loop is formed in the seal 15, as shown in FIG. 2. The expansion loop ensures that no strain is imparted to the seal 15 as a result of the differential expansion between the outer flow liner 11 and the exhaust cylinder 2.

Although the seal has been disclosed as utilized between the exhaust cylinder and outer flow liner in the exhaust section, it will be clear to those skilled in the art that the seal could be used in other sections of the gas turbine as well in order to prevent the undesirable flow of hot gas in areas of relatively low pressure differential.

Moreover, it should be realized that the present invention may be embodied in other specific forms without departing from the spirit or essential attributes thereof and, accordingly, reference should be made to the appended claims, rather than to the foregoing specification, as indicating the scope of the invention.

I claim:

1. A gas turbine comprising:

(a) an outer cylinder;
(b) an inner cylinder enclosed by said outer cylinder; and
(c) a seal extending between said inner and outer cylinders, said seal being formed from a cloth and having inner and outer edges, and further comprising an inner and outer retainer disposed on said inner and outer edges, respectively, said inner and outer retainers each comprising an arcuate channel, said cloth being retained within said channels.

2. The gas turbine according to claim 1, wherein said cloth is formed from fiber glass.

3. The gas turbine according to claim 1, wherein said seal further comprises first and second layers of mesh enclosing said cloth therebetween.

4. The gas turbine according to claim 3, wherein said mesh is formed from a metallic wire.

5. The gas turbine according to claim 1, wherein said cloth has an approximately rectangular shape in its undeformed state and wherein said arcuate channels form said cloth into an arcuate shape.

6. The gas turbine according to claim 1, wherein said inner and outer cylinders have first and second grooves, respectively, formed therein, said inner and outer channels being disposed in said first and second grooves, respectively.

7. The gas turbine according to claim 6, wherein said channels and said grooves have a dove tail shaped cross-section.

8. The gas turbine according to claim 1, wherein each of said channels has a throat opening, the width of said throat being less than the thickness of said cloth, whereby said cloth is retained in said channel by compression.

9. The gas turbine according to claim 1, wherein said seal is comprised of a plurality of arcuate members.

10. The gas turbine according to claim 9, wherein each of said arcuate member encompasses an arc of 180°.

11. The gas turbine according to claim 1 wherein said seal has means for accommodating relative motion between said inner and outer cylinders.

12. A gas turbine comprising:
a) an outer cylinder;
b) an inner cylinder enclosed by said outer cylinder; and
c) a seal extending between said inner and outer cylinders, said seal being formed from a cloth having inner and outer edges and further comprising an inner and outer retainer disposed on said inner and outer edges, respectively, for fixedly attaching said inner and outer edges to said inner and outer cylinders, respectively.

13. A gas turbine comprising:
a) an outer cylinder;
b) an inner cylinder enclosed by said outer cylinder; and
c) a seal extending between said inner and outer cylinders, said seal being formed from a cloth, a flexible loop formed in said cloth for accommodating relative motion between said inner and outer cylinders.

14. A gas turbine comprising:
a) an outer cylinder;
b) an inner cylinder enclosed by said outer cylinder; and
c) a seal extending between said inner and outer cylinders, said seal comprised of two layers of cloth having a flexible sheet disposed between said layers.

15. The gas turbine according to claim 14 wherein said flexible sheet is gas impermeable.

16. The gas turbine according to claim 14 wherein said flexible sheet is comprised of metal.

17. A gas turbine comprising:
a) a gas flow path;
b) an annular cavity having inner and outer diameters;
c) a liner forming a boundary between said gas flow path and said cavity, said cavity in flow communication with said gas flow path; and
d) a plurality of arcuate seal segments for preventing the flow of gas from said gas flow path through said cavity, each of said arcuate seal segments having a cloth portion extending through said cavity between said inner and outer diameters.

18. The gas turbine according to claim 17, wherein each said cloth portion is sandwiched between layers of wire mesh.

19. The gas turbine according to claim 17, further comprising a turbine section for producing gas at a temperature of at least approximately 370° C. (700° F.), said turbine section in gas flow communication with said gas flow path, wherein said gas flowing through said gas path is at a temperature of at least approximately 370° C. (700° F.) and said cloth is formed from fiber glass.

20. The gas turbine according to claim 19 wherein said gas flow path has means for dropping the pressure of said gas flowing therein by no more than approximately 13.8 kPa (2 psi).

21. The gas turbine according to claim 17 wherein said cavity is in flow communication with said gas flow path at first and second locations, said arcuate seal segments disposed between said first and second locations.

22. The gas turbine according to claim 21 wherein said gas flow path has means for dropping the pressure of said gas flowing therein by no more than approximately 13.8 kPa (2 psi), whereby the pressure at said first location is no more than approximately 13.8 kPa (2 psi) higher than the pressure at said second location.

23. The gas turbine according to claim 17 wherein the radial width of each of said arcuate seal segments prior to being installed in said cavity is greater than the radial distance between said inner and outer diameters, whereby a flexible loop is formed in each of said arcuate seal segments.

24. In a gas turbine having an exhaust cylinder enclosing a diffuser forming a hot gas flow path, said exhaust cylinder and said diffuser forming a dead air space therebetween, an apparatus for preventing hot gas in said hot gas flow path from flowing through said dead air space, comprising:
a) a first circumferentially extending groove formed in said exhaust cylinder;
b) a second circumferentially extending groove formed in said diffuser; and
c) an approximately rectangular cloth segment formed into an arcuate member by first and second arcuate retainers, said first and second retainers disposed in said first and second grooves, respectively, said cloth segment having upstream and downstream radially extending faces covered by a flexible protective layer.

25. A gas turbine comprising:
a) a gas flow path;

b) an annular cavity having inner and outer diameters;

c) a liner forming a boundary between said gas flow path and said cavity, said cavity in flow communication with said gas flow path; and d) an annular seal for preventing the flow of gas from said gas flow path through said cavity, said annular seal having a cloth portion extending through said cavity between said inner and outer diameters.

* * * * *